US006896528B2

(12) United States Patent
Kubota et al.

(10) Patent No.: US 6,896,528 B2
(45) Date of Patent: May 24, 2005

(54) CONNECTING STRUCTURE OF CONNECTORS

(75) Inventors: Katsuhiro Kubota, Ogasa-gun (JP); Keisuke Ozawa, Ogasa-gun (JP)

(73) Assignee: Yazaki Corporation, Tokyo (JP)

( * ) Notice: Subject to any disclaimer, the term of this patent is extended or adjusted under 35 U.S.C. 154(b) by 35 days.

(21) Appl. No.: 10/608,231

(22) Filed: Jun. 30, 2003

(65) Prior Publication Data

US 2004/0005804 A1 Jan. 8, 2004

(30) Foreign Application Priority Data

Jul. 2, 2002 (JP) ..... P2002-193124

(51) Int. Cl.[7] ..... H01R 13/44

(52) U.S. Cl. ..... 439/135; 439/352; 439/232; 439/157

(58) Field of Search ..... 439/347–352, 439/157, 135, 232, 159

(56) References Cited

U.S. PATENT DOCUMENTS 5,017,147 A 5/1991 Sugiyama et al.
5,727,959 A * 3/1998 Yagi et al. ..... 439/157
6,012,945 A 1/2000 Tabor et al.
6,113,414 A 9/2000 Fukuda
6,183,279 B1 * 2/2001 Murakami et al. ..... 439/157

FOREIGN PATENT DOCUMENTS

DE 196 17 792 A1 11/1997
JP 5-45063 Y2 11/1993

* cited by examiner

*Primary Examiner*—Truc Nguyen
(74) *Attorney, Agent, or Firm*—Sughrue Mion, PLLC

(57) ABSTRACT

In a stationary member adapted to be electrically connected with at least one connecting member, a first connecting member is attached to a first connecting part. A cover member is slidable between a first position to lock the first connecting member at the first connecting part and a second position to enable an attachment of the first connecting member to the first connecting part. The cover member is provided with a first engagement member. A second engagement member engages with the first engagement member in a case where the cover member is located at the first position.

8 Claims, 5 Drawing Sheets

CONNECTING STRUCTURE OF CONNECTORS

BACKGROUND OF THE INVENTION

The present invention relates to a connecting structure of connectors which can connect the connector, particularly the connector which is electrically connected to a specified electrical component such as an air back, with relatively higher reliability of electrical connection.

In an automobile, for example, there are provided a number of electrical components. Almost all these electrical components are connected to a power supply by way of electric wires such as wire harnesses. The electric wires are electrically connected to connectors which are provided on a stationary member such as an electrical junction box including a junction block, relay block, connector block and so on, and an instrument panel.

Among these connectors, there are some connectors in which reliability of the electrical connection is particularly severely requested depending on the electrical components to be electrically connected. Specifically, there are some specified electrical components such as an electronically controlled fuel injection device, an airbag, for example, which require more strict management than other electrical components from a viewpoint of safety. These apparatuses must be managed so as to be free from malfunction, and so, in the connector to be electrically connected to the air bag (an airbag connector), for example, reliability of electrical connection is particularly severely requested.

For this reason, it has been proposed that the specified connectors such as the airbag connector are provided with connector covers, so that these connectors may not be disconnected when they are once engaged and connected with the connectors of the electrical junction box or the instrument panel.

More specifically, after the airbag connector has been engaged and connected with the connector of the electrical junction box (a connector for airbag), the connector cover is provided so as to cover substantially the whole body of the airbag connector, so that the electrical connection between the airbag connector and the connector for airbag cannot be released unless this connector cover is removed. In this manner, the reliability of the electrical connection of the airbag connector will be enhanced.

Although the reliability of the electrical connection of the airbag connector can be enhanced by providing the connector cover in this manner, the connector cover becomes inevitably large, because it must be covered over and fitted to the airbag connector.

SUMMARY OF THE INVENTION

It is therefore an object of the invention to provide a connecting structure of connectors in which a connector cover can be made compact.

In order to achieve the above object, according to the invention, there is provided a stationary member, adapted to be electrically connected with at least one connecting member, comprising:

a first connecting part, to which a first connecting member is attached;

a cover member, slidable between a first position to lock the first connecting member at the first connecting part and a second position to enable an attachment of the first connecting member to the first connecting part, the cover member provided with a first engagement member; and a second engagement member, which engages with the first engagement member in a case where the cover member is located at the first position.

In such a configuration, by sliding the cover member to the first position, after the first connecting member has been connected to the first connecting part in a state where the cover member is positioned in the second position, the first engagement member of the cover member is engaged with the second engagement member of the stationary member thereby to lock the cover member, and at the same time, the cover member is engaged with the first connecting member thereby to prevent disconnection of the first connecting member. Since the disconnection of the first connecting member is prevented by merely sliding the cover member, the cover member can be made compact.

Preferably, the stationary member further comprises a second connecting part, to which a second connecting member is attached. Here, an attachment of the second connecting member is disabled by the cover member located at the second position.

In such a configuration, because the second connecting member cannot be attached to the second connecting part when the cover member is positioned in the second position, connection of the first connecting member must be first performed. Therefore, connection of the first connecting member to the first connecting part can be reliably performed without fail.

Here, it is preferable that the cover member serves as a partition between the first connecting part and the second connecting part, in the case where the cover member is located at the first position.

In such a configuration, the second connecting member can be reliably mounted to the second connecting part.

It is also preferable that the attachment of the second connecting member to the second connecting part is enabled only in the case where the cover member is located at the first position.

In such a configuration, the second connecting member cannot be mounted to the second connecting part, unless the cover member is slid to move to the first position after the first connecting member has been connected to the fixed connecting part. Therefore, connection of the first connecting member to the first connecting part can be more reliably performed.

It is also preferable that the first connecting part and the second connecting part have an identical configuration.

In such a configuration, sliding structure of the cover member can be easily designed.

Preferably, the stationary member further comprises a third engagement member, which engages with the first engagement member in a case where the cover member is located at the second position.

In such a configuration, when the first connecting member is to be connected to the first connecting part, the cover member can be locked into the second position. Therefore, connection of the first connecting member can be performed without interference with the cover member.

Preferably, the first connecting member is electrically connected with an automotive electrical equipment which requires relatively strict management in view of safety.

In such a configuration, even the first connecting member whose reliability of electrical connection is particularly severely requested can be connected to the first connecting part with high reliability of electrical connection, and high industrial value can be attained.

Here, it is preferable that the automotive electrical equipment is an air bag or an electronically controlled fuel injection device.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Now, one embodiment of the invention will be described referring to the accompanying drawings.

Figure 1:
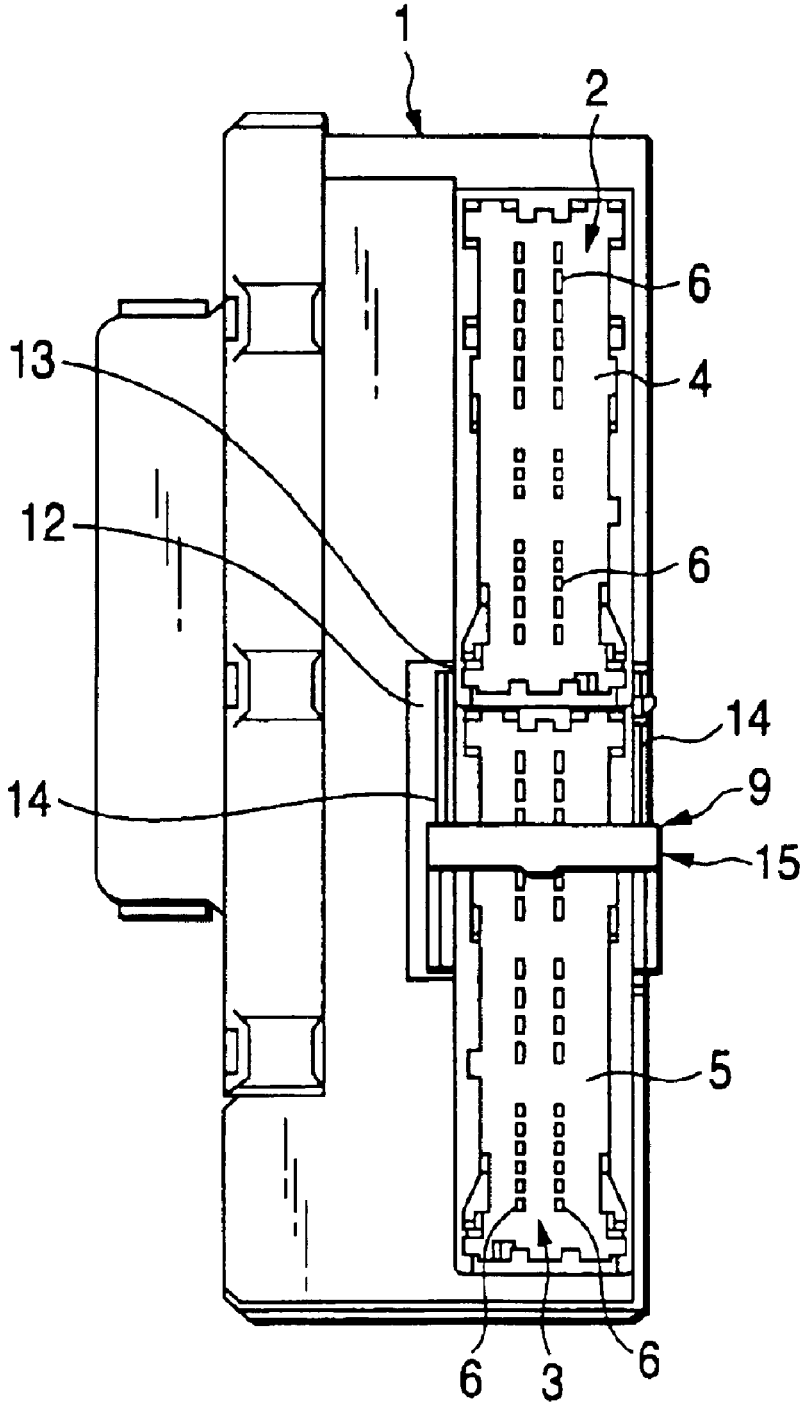
FIG. 1 is a front view showing a connecting structure of connectors according to one embodiment of the present invention.
Figure 2:
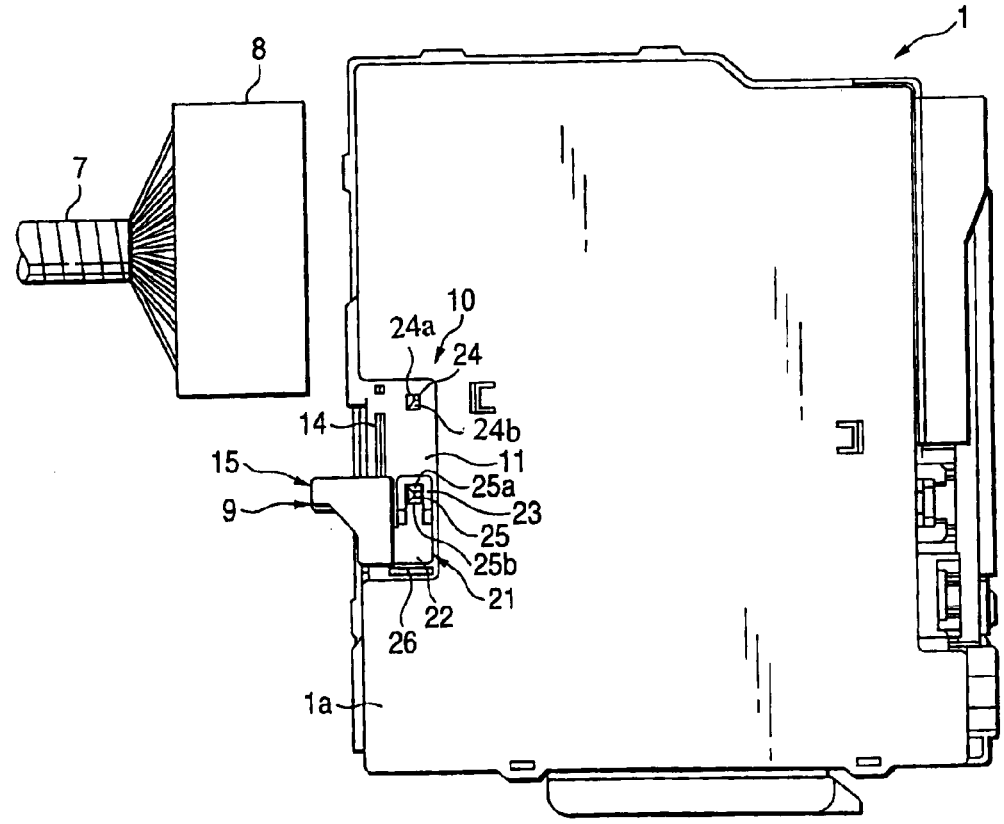
FIG. 2 is a side view showing the connecting structure.
Figure 3:
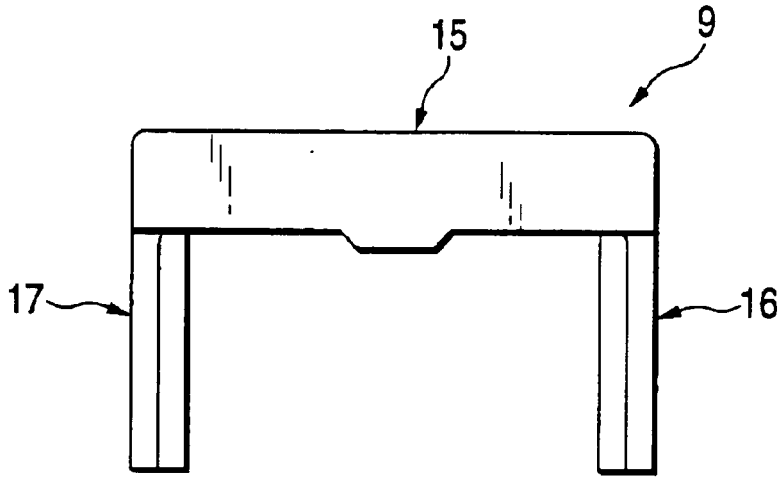
FIG. 3 is a front view showing a connector cover in the connecting structure.

FIGS. 1 and 2 show a connecting structure of connectors according to the invention. In this figures, a stationary member 1 is an electrical junction box such as a junction block, relay block, connector block, ECU BOX, protector, and so on, or an instrument panel. In this embodiment, description will be made referring to a case in which the electrical junction box is employed as the stationary member.

The electrical junction box 1 is formed in a shape of a substantially rectangular box, and fixed on an instrument panel, for example, by way of a bracket or the like. In the electrical junction box 1, there is provided an assembly (not shown) of flat circuit bodies including a plurality of flat circuit bodies stacked on one another, each of the flat circuit bodies having a plurality of electric wires.

Two female type connectors 2, 3 are juxtaposed on one side face of the electrical junction box 1. These female type connectors 2, 3 respectively include fitting recesses 4, 5 having a substantially rectangular cross section with which male type connectors attached to ends of electric wires such as wire harnesses, for example, can be fitted. These female type connectors 2, 3 are juxtaposed on a center line extending along a longitudinal direction of the electrical junction box 1. A plurality of terminals 6 are provided in a projecting manner in the fitting recesses 4, 5. The terminals 6 in the female type connectors 2, 3 are respectively arranged in two rows along the longitudinal direction of the female type connectors 2, 3. These terminals 6 are electrically connected respectively to desired electric wires of the assembly of the flat circuit bodies, by a press-fitting manner, for example.

One of the female type connectors is a connector 2 with which a specified connector 8 attached to an end of a wire harness 7, for example, electrically connected to a specified electrical component is adapted to be engaged and connected. The other female type connector 3 is a connector (not shown), that is, another component attached to an end of a wire harness, for example, electrically connected to another electrical component which is not the specified electrical component is adapted to be engaged and connected.

The specified electrical component means the electrical component which requires more strict management than other electrical components from a viewpoint of safety, and includes an electronically controlled fuel injection apparatus, airbag, etc. for example. These apparatuses must be managed so as to be free from malfunction, and so, as for the specified connector (airbag connector) 8 adapted to be electrically connected to the airbag, for example, reliability of electrical connection is particularly severely requested.

The electrical junction box 1 is provided with a cover mounting part 10 for slidably mounting a connector cover 9.

The cover mounting part 10 is provided on both side areas forming the connector parts 2, 3 extending from a substantially middle part of the connector part 3. Specifically, the cover mounting part 10 consists of a first mounting part 11 which is dented from a surface 1*a* of the electrical junction box 1, and a second mounting part 13 which is a recess 12 cut out from an area of the electrical junction box 1 opposed to the first mounting part 11 while interposing the connector parts 2, 3.

In the first and second mounting pans 11, 13, guide rails 14 extending in a longitudinal direction of the connector part 3 are respectively provided. The connector cover 9 is adapted to be supported (mounted) by these guide rails 14 in such a manner that the connector cover 9 can slidably move between a locked position shown in FIGS. 6A and 6B, and an unlocked position, shown in FIGS. 1 and 2. The locked position is a position in which the connector cover 9 is engaged with the specified connector 8 which has been engaged and connected with the connector part 2 in order to prevent the specified connector 8 from disconnecting therefrom. The unlocked position is a position in which connection of the specified connector 8 to the connector part 2 can be performed, and more preferably, the position in which connection of another connector to the connector part 3 cannot be performed.

As shown in the accompanying drawings, the connector cover 9 is formed substantially in a shape of a gate so as to bridge across the connector part 3. Specifically, the connector cover 9 includes a cover portion 15 positioned substantially in parallel to one side face of the electrical junction box 1, and a pair of leg portions 16, 17 which are integrally formed with both ends of the cover portion 15 and adapted to be slidably engaged with the guide rails 14.

A pair of the leg portions 16, 17 are formed in a shape of flat plate extending substantially in parallel to the first and second mounting parts 11, 13. Height of the leg portions 16, 17 are arbitrarily selected within a range in which the cover portion 15 can be positioned on the connector part 3.

Figure 4:
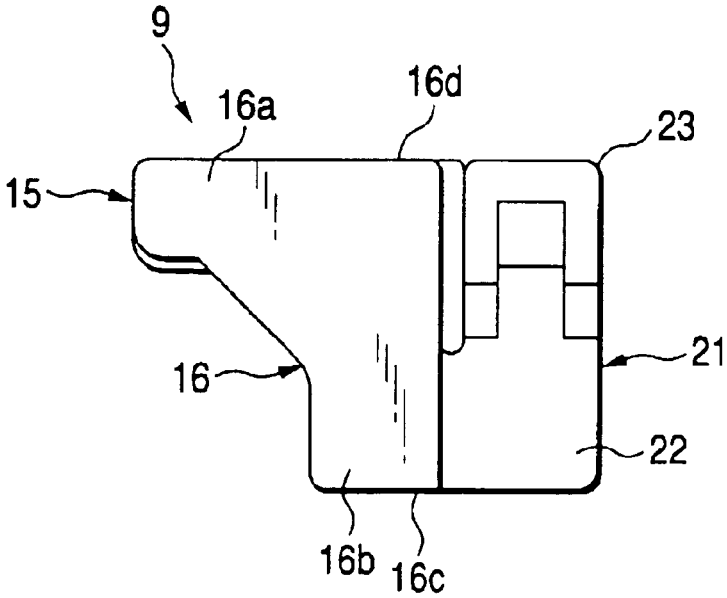
FIG. 4 is a side view showing the connector cover.
Figure 5:
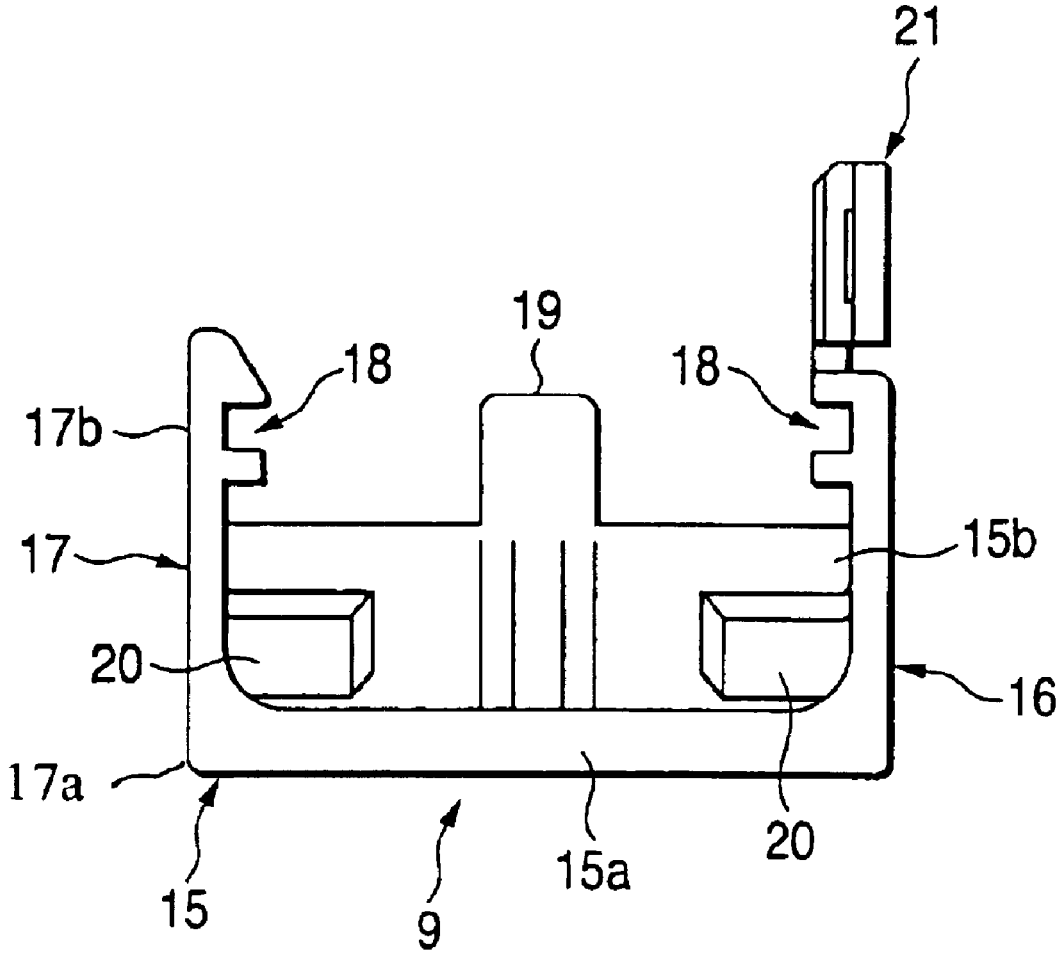
FIG. 5 is a rear view showing the connector cover.

The leg portions 16, 17 are formed substantially in an L-shape, consisting of vertical portions 16*a*, 17*a* which extend from both ends of the cover portion 15 in a direction substantially perpendicular to the cover portion 15, and horizontal portions 16*b*, 17*b* which further extend from lower end (the right side in FIGS. 2 and 4) of the vertical portions 16*a*, 17*a* in a further perpendicular direction.

A pair of the leg portions 16, 17 respectively have, on their opposed faces at distal ends thereof, slide fitting recesses 18 which are formed to be dented and open in a direction opposed to each other for engagement with the guide rails 14.

The cover portion 15 is formed substantially in an L-shape in cross section, consisting of: a first flat plate portion 15*a* which extends in a direction substantially perpendicular to the vertical portion 16*a*, 17*a* (the longitudinal direction of the connector part 3) having a same width as that of the upper ends (the left side in FIGS. 2 and 4) of the vertical portions 16*a*, 17*a* of the leg portions 16, 17; and a second flat plate portion 15*b* which is integrally and perpendicularly attached to a side of the first flat plate portion 15*a* from which the horizontal portions 16*b*, 17*b* are extended. The second flat plate portion 15*b* is also integrally attached to the horizontal portions 16*b*, 17*b*.

The second flat plate portion 15*b* is provided, in a substantially middle part of its one end at an opposite side to the first flat plate portion 15*a*, with a projected part 19 which is adapted to be positioned between the two rows of the terminals 6 of the connector part 3.

Moreover, at both sides of the second flat plate portion 15*b* adjacent to both side end parts of the first flat plate portion 15*a*, there are respectively provided disconnection stoppers 20 which extend along the first flat plate portion 15*a*.

The disconnection stoppers 20 serve to prevent the specified connector 8 from disconnecting from the connector part 2 by being engaged with the specified connector 8, when the connector cover 9 is slid from the unlocked position to the locked position after the specified connector 8 has been engaged and connected with the connector part 2. The disconnection stoppers 20 may be formed in any manner, provided that it can prevent disconnection of the specified connector 8 from the connector part 2. For example, the disconnection stoppers 20 may be provided substantially over almost all area of the second flat plate portion 15*b* adjacent to the side ends of the first flat plate portion 15*a*. Further, the disconnection stoppers 20 can be formed in any shape such as a circle, ellipse, polygon, and is formed in a substantially rectangular shape in section, in the illustrated example. The disconnection stoppers 20 are preferably formed in such a manner that they can be engaged with the specified connector 8 only in a state where the specified connector 8 has been completely engaged with the connector part 2.

The connector cover 9 is provided with a cover locking part 21 for locking the connector cover 9 in the locked position and the unlocked position of the electrical junction box 1.

The cover locking part 21 is, for example, a locking frame provided on an end face (a face of an opposite end to the vertical portion) of the horizontal portion 16*b* of the leg portion 16 at the side of the first mounting part 11. The locking frame 21 is formed in a substantially rectangular shape having substantially the same size as the horizontal portion 16*b* of the leg portion 16. This locking frame 21 consists of: a base part 22 in a substantially rectangular shape extending entirely along the horizontal portion 16*b* (between ends 16*c*, 16*d*) and adapted to slide on a surface of the first mounting part 11; and a frame part 23 which extends in a C-shape from both ends of the base part 22 adjacent to the end 16*d*.

Although the locking frame 21 is provided only in the leg portion 16 at the side of the first mounting part 11, it may be provided also in the remaining leg portion 17 at the side of the second mounting part 13, or may be provided only in the leg portion 17 at the side of the second mounting part 13.

The first mounting part 11 is provided with a plenary locking part 24 and a provisional locking part 25 adapted to be engaged with the locking frame 21.

The plenary locking part includes a plenary locking projection 24 which projects into a place of the first mounting part 11 in which the frame part 23 of the locking frame 21 is positioned when the connector cover 9 has been positioned in the locked position, for example. The plenary locking projection 24 may be formed in any shape, provided that it can be engaged with the locking frame 21 to lock the connector cover 9, and may be formed in a rectangular shape, for example.

The plenary locking projection 24 is formed to have such a height that the frame part 23 of the locking frame 21 can ride over the plenary locking projection 24 when the connector cover 9 is slid to the locked position.

Moreover, a face 24*a* of the plenary locking projection 24 at the side of the unlocked position (the face to which the frame part 23 first comes into contact) is preferably formed in a sloped face whose height is gradually reduced toward the connector part 3 along a moving direction of the connector cover 9. A face 24*b* of the plenary locking projection 24 at the opposite side to the first face 24*a* is preferably formed as a vertical plane substantially perpendicular to the first mounting part 11.

A provisional locking projection 25 projects into a place of the first mounting part 11 in which the frame part 23 of the locking frame 21 is positioned when the connector cover 9 has been positioned in the unlocked position, for example. The provisional locking projection 25 may be formed in any shape, provided that it can be engaged with the locking frame 21 to lock the connector cover 9, and may be formed in a rectangular shape, for example.

The provisional locking projection 25 is formed to have such a height that the base part 22 of the locking frame 21 can ride over the provisional locking projection 25 when the connector cover 9 is slid to the unlocked position.

Moreover, both faces 25*a*, 25*b* of the provisional locking projection 25 in the direction of sliding movement of the connector cover 9 are preferably formed as sloped faces.

The first mounting part 11 is further provided with a stopper 26 which comes into contact with an end of the base part 22 of the locking frame 21 in order to prevent the connector cover 9 from moving from the locked position to the unlocked position, when the connector cover 9 has been positioned in the unlocked position.

Now, in order that the specified connector 8 may be engaged and connected with the connector part 2 of this electrical junction box 1, the connector cover 9 is kept in the unlocked position. In this state, a distal end portion of the specified connector 8 is aligned with the fitting recess 4 of the connector part 2, and the specified connector 8 is inserted into the fitting recess 4. In this manner, the specified connector 8 is engaged with the connector part 2 to be electrically connected. On this occasion, the specified connector 8 can be connected with the connector part 2 without interference with the connector cover 9, because the locking frame 21 is engaged with the provisional locking projection 25 to maintain the connector cover 9 in the unlocked position.

Then, the connector cover 9 is slid to move from the unlocked position to the locked position. When the connector cover 9 has been positioned in the locked position, the connector cover 9 is engaged with a part of the specified connector 8 which has been engaged and connected with the connector part 2 so as to prevent disconnection of the specified connector 8 from the connector part 2. The locking frame 21 of the connector cover 9 is also engaged with the plenary locking projection 24 to lock the connector cover 9 in the locked position. On this occasion, because the connector cover 9 which has been engaged with the plenary locking projection 24 can hardly move toward the unlocked position due to the vertical plane of the second face 24*b* of the plenary locking projection 24, the connector cover 9 can be rigidly retained in the locked position. The connector cover 9 rarely moves from the locked position in a locking direction (a direction from the unlocked position to the locked position) since the connector cover 9 is in engagement (contact) with the specified connector 8.

Then, after the connector cover 9 has been moved to the locked position, the other connector, for example, is inserted into the connector part 3 to electrically connect the other connector with the connector part 3.

Accordingly, by slidably moving the connector cover 9 to be engaged with a part of the specified connector 8, disconnection of the specified connector 8 from the connector cover 9 can be prevented, and therefore, the connector cover 9 can be made compact as compared with a case in which substantially the whole of the specified connector 8 is covered with a cover member. In this manner, even in case where the specified connector 8 is such a connector as electrically connected to a specified electrical component, that is, the connector whose reliability of electrical connection is particularly severely requested, the specified connector can be connected to the fixed connector with high reliability of electrical connection, and high industrial value can be attained.

Moreover, because the unlocked position is such a position that connection of the other connector to the connector part 3 would be hindered, the other connector cannot be connected to the connector part 3 when the connector cover 9 is in the unlocked position. For this reason, the specified connector 8 must be connected first, and therefore, connection of the specified connector 8 to the connector part 2 can be reliably performed without fail.

Figure 6B:
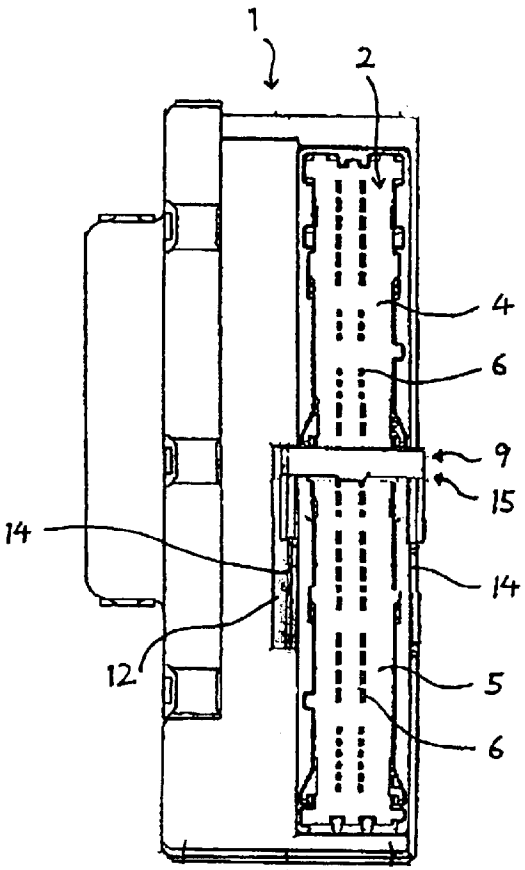
FIGS. 6A and 6B are side and front views, respectively, of the connecting structure.
Figure 6A:
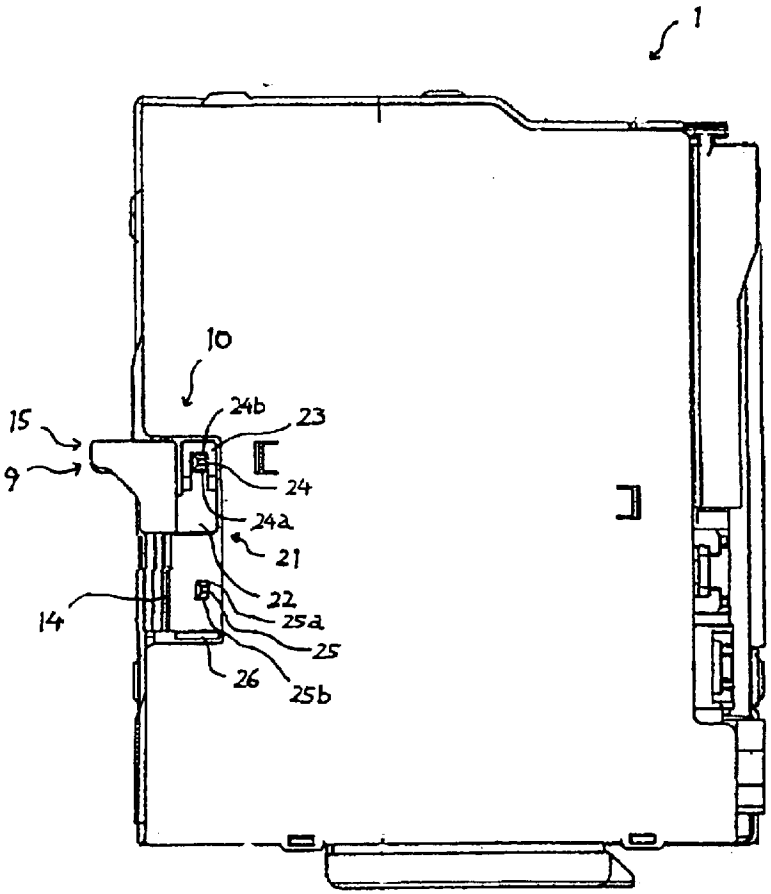

Further, when the connector cover 9 is positioned in the locked position, the cover portion 15 serves as a partition for separating the connector part 2 from the connector part 3, as shown in FIG. 6B. As the results, it will be easy to connect the other connector to the connector part 3, and the connection can be reliably performed.

Moreover, since the connector part 2 and the connector part 3 are juxtaposed adjacently to each other on the center line extending in a longitudinal direction of the electrical junction box 1, the sliding structure of the connector cover 9 can be easily configured.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A stationary member, adapted to be electrically connected with at least one connecting member, comprising:

a first connecting part, to which a first connecting member is attached;

a cover member, slidable between a first position at which the cover member locks the first connecting member to the first connecting part and a second position at which attachment of the first connecting member to the first connecting part is enabled, the cover member provided with a first engagement member; and a second engagement member, which engages with the first engagement member in a case where the cover member is located at the first position;

a second connecting part to which a second connecting member is attached, wherein an attachment of the second connecting member is disabled by the cover member located at the second position.

2. The stationary member as set forth in claim 1, wherein the cover member serves as a partition between the first connecting part and the second connecting part, in the case where the cover member is located at the first position.

3. The stationary member as set forth in claim 1, wherein the attachment of the second connecting member to the second connecting part is enabled only in the case where the cover member is located at the first position.

4. The stationary member as set forth in claim 1, wherein the first connecting part and the second connecting part have an identical configuration.

5. The stationary member as set forth in claim 1, further comprising a third engagement member, which engages with the first engagement member in a case where the cover member is located at the second position.

6. The stationary member as set forth in claim 1, wherein the first connecting member is electrically connected with an automotive electrical equipment which requires relatively strict management in view of safety.

7. The stationary member as set forth in claim 6, wherein the automotive electrical equipment is an air bag.

8. The stationary member as set forth in claim 6, wherein the automotive electrical equipment is an electronically controlled fuel injection device.

* * * * *